United States Patent [19]

Parr et al.

[11] 4,416,399

[45] Nov. 22, 1983

[54] AEROSOL CANISTER

[75] Inventors: Erwin W. Parr; Timothy B. Brandt, both of Des Moines, Iowa

[73] Assignee: Ziphron, Inc., Des Moines, Iowa

[21] Appl. No.: 272,908

[22] Filed: Jun. 12, 1981

[51] Int. Cl.[3] ..... B65D 83/14

[52] U.S. Cl. ..... 222/402.13; 222/402.24

[58] Field of Search ..... 222/153, 402.11, 402.13, 222/402.15, 402.24

[56] References Cited

U.S. PATENT DOCUMENTS

| | | | |
|---|---|---|---|
| 3,474,939 | 10/1969 | O'Donnell et al. . | |
| 3,484,023 | 12/1969 | Meshberg . | |
| 3,602,399 | 8/1971 | Litman et al. . | |
| 3,744,682 | 7/1973 | Blank | 222/402.13 X |
| 3,854,632 | 12/1974 | Smrt . | |
| 4,011,970 | 3/1977 | Crowle et al. | 222/402.13 X |
| 4,044,922 | 8/1977 | Bordelon . | |
| 4,065,036 | 12/1977 | Kirk | 222/402.11 X |
| 4,132,333 | 1/1979 | Debard | 222/402.13 |
| 4,333,589 | 6/1982 | Bush | 222/402.13 X |

FOREIGN PATENT DOCUMENTS

| | | | |
|---|---|---|---|
| 2502903 | 8/1975 | Fed. Rep. of Germany | 222/402.13 |

*Primary Examiner*—F. J. Bartuska

*Attorney, Agent, or Firm*—Henderson & Sturm

[57] ABSTRACT

An actuator mechanism for an aerosol container of a type including a chamber for holding fluid under pressure has an outlet opening disposed in the container and a valve attached to the container for controlling the flow of fluid from the opening. The actuator mechanism includes a cap having an outlet opening on one side thereof, which cap is attached to the container adjacent to the outlet opening of the container. An actuation structure is provided for selectively causing fluid to be dispensed from said chamber and out through the outlet opening of the cap upon reciprocation of the actuation structure with respect to the container. The actuation structure includes a nozzle for permitting fluid to be sprayed therethrough. The nozzle is aligned with the outlet opening in the cap. A stem is operatively attached to the nozzle and to the valve for communicating fluid from the container chamber, through the valve and the nozzle when the valve is open. An access opening is disposed in the cap for permitting manual reciprocation of the actuation structure and a flap having a frangible connection thereon is disposed in such access opening. The actuation structure is slideably connected to the cap for preventing the stem from bending during actuation of the actuation structure.

1 Claim, 8 Drawing Figures

AEROSOL CANISTER

BACKGROUND OF THE INVENTION

The present invention relates to aerosol containers, and more particularly to a heavy duty actuator for aerosol containers with emphasis on reliability rather than cost.

Because of the vast numbers of aerosol containers that are commercially produced and sold, the emphasis in the design of such containers has been more on keeping the cost thereof low than on reliability. One reason that industry has made this choice is that it is not particularly critical if a small percentage of the containers leak or cannot be actuated. As a result of this trend in the aerosol container industry, there are many fluids which could be packaged in aerosol containers, but which are not, because the fluids are expensive or it is critical that fluid does not leak out; and no sufficiently reliable aerosol containers can be found commercially available that will satisfy the reliability criteria needed for packaging of such fluids.

Many of the expensive fluids that could be packaged in reliable aerosol containers are in the medical and pharmaceutical fields.

One of the types of fluids which require a very reliable container valve and actuator is a C.S. weapon of a type carried by police to immobilize people or for example as shown by protective device disclosed in U.S. Pat. No. 4,044,922 which is designed to be carried by the average citizen for protection against criminals. Because of the demand for the latter type of immobilizing sprayers, many containers which are designed for use with non-critical types of fluids to be placed therein are now being filled with C.S. liquid, teargas or the like. One example of such a container in common usage for this purpose is U.S. Pat. No. 3,484,023. Such latter mentioned patent does disclose a locking feature which is an advance over the art which was prior thereto, but there is still a serious problem in using such container for C.S. liquid because of reliability problems and because the locking mechanism can easily be accidentally disengaged and the weapon fired accidentally.

When a C.S. weapon is fired accidentally, there are two major problems. The first problem is the obvious one that the C.S. liquid can immobilize someone for whom it was not intended to be used, for example on the owner of the C.S. weapon. Another, and almost more serious problem, is when the device is emptied accidentally and the owner is not aware that the device has been emptied. Under such circumstances, the owner of such device has a false sense of security and when an emergency situation does arise, such as when the owner of the C.S. weapon is attacked, for example in a robbery attempt, an attempt to use an empty or inoperable C.S. weapon can have disastrous results.

One approach to prevent accidental firing or accidental disengagement of the locking mechanism of the above identified U.S. Pat. No. 3,484,023 has been to place such a container in a holster or the like. U.S. Pat. No. 4,220,263 to Caruso discloses such a combination, but not for that purpose. Quite often such a holster is placed in a purse or the like with other small items such as pens, pencils, small cosmetic items or the like. These small items can, however, extend into the holster and cause the locking mechanism to be disengaged and can consequently result in an accidental firing of the device within a purse or the like. As mentioned above, this can be dangerous, expensive, and result in an empty container without being aware that it is empty, which can be the worst condition of all.

Consequently, it is clear from the above discussion that there is a need for more reliable aerosol packages for use with expensive fluids or with other devices such as C.S. weapons wherein it is critical that the fluid not leak out in advance and flow from the container when needed in a critical situation.

SUMMARY OF THE INVENTION

The present invention relates to an actuator mechanism for an aerosol container of a type including a chamber for holding fluid under pressure having an outlet opening disposed in the container and a valve attached to the container for controlling the flow of fluid from the outlet opening. The actuator mechanism includes a cap having an outlet opening on one side thereof, which cap is attached to the container adjacent to the outlet opening of the container. An actuation structure is provided for selectively causing fluid to be dispensed from said chamber and out through the outlet opening of the cap upon reciprocation of the actuation structure with respect to the container. The actuation structure includes a nozzle for permitting fluid to be sprayed therethrough. The nozzle is aligned with the outlet opening in the cap. A stem is operatively attached to the nozzle and to the valve for communicating fluid from the container chamber, through the valve and the nozzle when the valve is open. An access opening is disposed in the cap for permitting manual reciprocation of the actuation structure and a flap having a frangible connection thereon is disposed in such access opening. The actuation structure is slideably connected to the cap for preventing the stem from bending during actuation of the actuation structure.

An object of the present invention is to provide an improved aerosol container and actuator therefor.

Another object of the invention is to provide an aerosol container and actuator which is extremely reliable in operation.

A further object of the invention is to provide an aerosol container which resists accidental actuation thereof.

A still further object of the invention is to provide an aerosol container which prevents bending of the stem connecting the valve and nozzle of an actuator.

Another object is to provide a protective cap for an aerosol container which cannot be placed on backwards.

Other objects, advantages, and novel features of the present invention will become apparent from the following detailed description of the invention when considered in conjunction with the accompanying drawings.

DESCRIPTION OF THE PREFERRED EMBODIMENT

Figure 1:
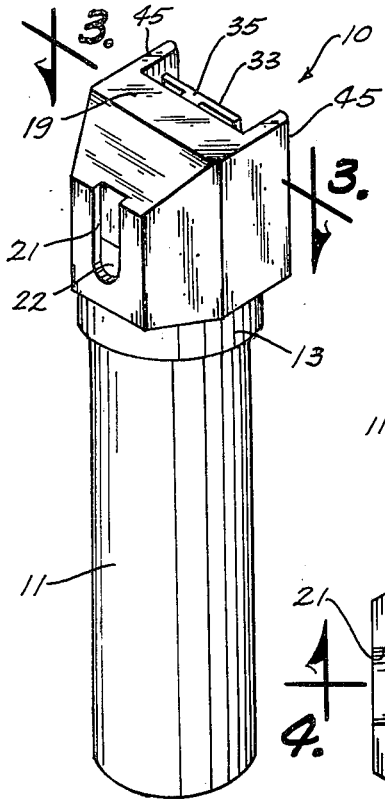
FIG. 1 is a perspective view of the preferred embodiment of the present invention.
Figure 4:
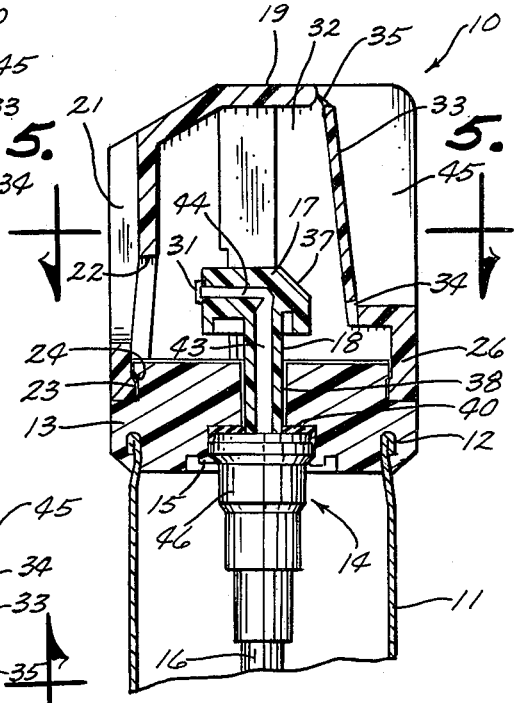
FIG. 4 is an enlarged partial cross-sectional view taken along line 4—4 of FIG. 3.
Figure 5:
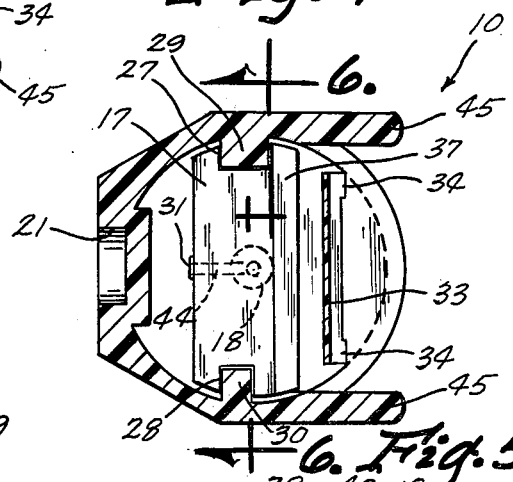
FIG. 5 is a cross-sectional view taken along line 5—5 of FIG. 4.

Referring now to the drawings wherein like reference numerals designate identical corresponding parts of the several views, FIG. 1 shows an aerosol container 10 constructed in accordance with the present invention. A tubular shaped container 11 is provided having a closed bottom and a top curl sealed portion 12 and a top closure member 13 attached thereto in a manner disclosed in U.S. Pat. No. 3,902,746 to Brandt. A valve assembly 14 is disposed centrally of the top closure member 13 and is held in place by an annular flange 15 which is initially straight when the valve 14 is inserted and is then bent over to hold the valve in place, as can readily be appreciated by viewing FIGS. 4 and 8.

The valve 14 is a standard commercially available valve, which will be described in greater detail below. A plastic tube 16 is inserted into the bottom of the valve 14, in a conventional manner, and this tube 16 extends downwardly to the bottom of the container 11 to take fluid only off of the bottom of the container 11.

Figure 8:
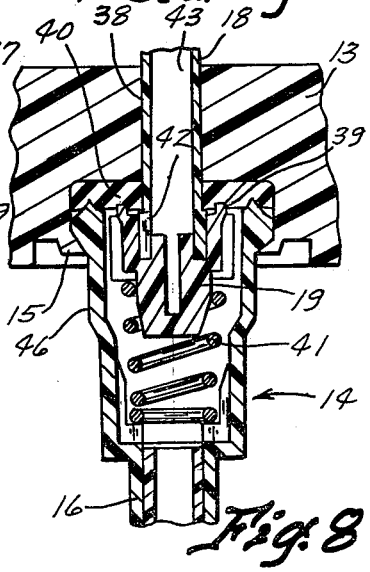
FIG. 8 is an enlarged cross-sectional view of the valve and the top closure member for the container.

An actuator structure 17 is disposed above the top closure member 13 and has a downwardly extending stem section 18 which extends into the valve member 19 shown in FIG. 8. A molded plastic cap portion 19 has a front cut-out slot 21 disposed therein and an opening 22 for allowing spray from the actuator 17 to pass therethrough. An annular inwardly extending projection 23 is disposed on the lower portion of the cap 19 and extends into an annular groove 24 formed by an upper annular outwardly extending ring 26 on the closure member 13. The actuator 17 has a first groove or notch 27 in one side thereof and a smaller groove or notch 28 in the other side thereof. The cap 19 has a first larger projection or gib 29 for fitting into the larger groove 27 on one side thereof and a smaller projection for fitting into the smaller groove 28 on the other side thereof. The gib structure, including the grooves 27 and 28 and the projections 29 and 30, provide a means for preventing the nozzle portion 31 from being misaligned with respect to the cap 19 and the cap opening 22. That is to say that the cap 19 must be plaaced over the actuator 17 in the manner shown, because the larger projection 29 will not fit into the small groove 28 on the actuator 17.

Figure 2:
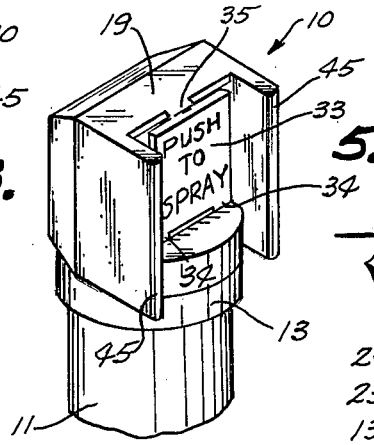
FIG. 2 is a partial perspective view of the FIG. 1 device shown from the other side thereof.
Figure 3:
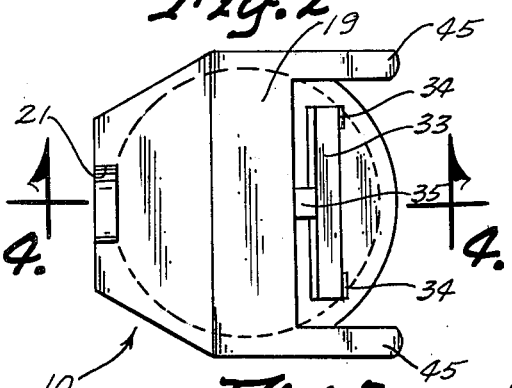
FIG. 3 is a top plan view taken along line 3—3 of FIG. 1.

An acess opening 32 is provided on the back side of the cap 19, but this access opening 32 has a flap member 33 disposed therein to prevent accidental actuation of the actuator 17. A pair of stronger hinge attachments 34 at the bottom of the flap member 33 are initially integrally molded such that the flap 33 can be molded in one piece with the cap 19. Another frangible attachment 35 attachs the top of the cap 19 to the top of the flap 33 as can best be seen in FIGS. 2 and 4.

Consequently, the aerosol container 10 can be thrown into a purse or the like without a fear that small items such as lipstick, pens, pencils or the like would extend through the opening 32 and inadvertantly actuate the actuator 17.

Figure 7:
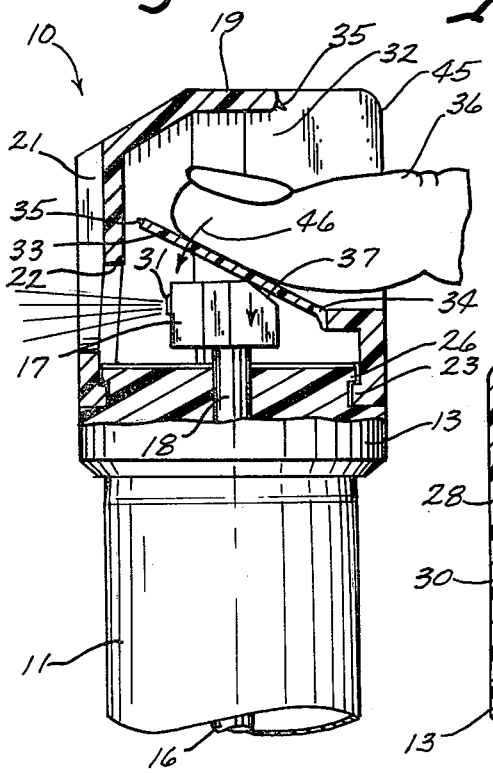
FIG. 7 is a partial enlarged cross-sectional view similar to FIG. 4, but showing the apparatus being actuated.
Figure 6:
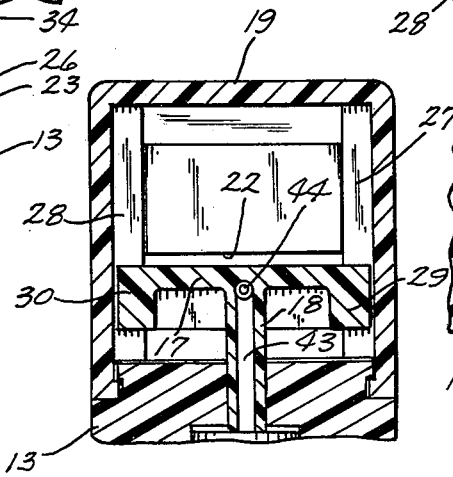
FIG. 6 is a cross-sectional view taken along line 6—6 of FIG. 5.

When it is desired to use the invention 10, the thumb 36 or any other finger, for that matter, is merely pushed forcefully against the flap 33 until the frangible member 35 is broken. Once that is done, the flap 33 will be hinged about the hinge members 34 and will strike the actuator 17 on the flap surface 37 thereof, for example as shown in FIG. 7. When this is done, the action of the thumb or finger 36 pushes the actuator 17 downwardly, thereby causing the stem 18 to be moved downwardly through the opening 38 and the closure member 13; and, referring to FIG. 8, this actuator 18 pushes down the valve member 19 and the valve 14. When this is done, the top annular portion 39 of the valve member 19 moves away from the seal 40, thereby allowing the flow of fluid up through the stem 16, past the biasing spring 41, and around and over the annular ring 39, out through the slot 42 in the stem 18, and then up through the opening 43 in the valve stem. From opening 43 the fluid passes through the opening 44 in the actuating member 17 and out the hole in the nozzle 31, such that the fluid sprays out through the opening 22 in the cap 19, for example as shown in FIG. 7. Flap members 45 help to guide the thumb or finger 36 as the flap 33 is pushed.

Accordingly it can be appreciated that the above described embodiment of this invention does indeed accomplish all of the aforesaid objects. Obviously many modifications and variations of the present invention are possible in light of the above teachings. It is therefore to be understood that, within the scope of the appended claims, the invention may be practiced otherwise than as specifically described.

We claim:

1. An actuator mechanism for an aerosol container of a type including a chamber for holding fluid under pressure, an outlet opening disposed in said container, and valve means attached to said container for controlling the flow of fluid from said outlet opening, said actuator mechanism comprising:

a cap having an outlet opening on one side thereof;

means for attaching said cap to said container adjacent to said outlet opening;

actuation means for selectively causing fluid to be dispensed from said chamber and out through the outlet opening of said cap upon reciprocation of said actuation means with respect to said container, said actuation means including nozzle means for permitting fluid to be sprayed therethrough, said nozzle means being aligned with the outlet opening in said cap, and stem means operatively attached to said nozzle means and to said valve means for communicating fluid from the container chamber, through said valve means and to said nozzle means when said valve means is open;

access means disposed in said cap for permitting manual reciprocation of said actuation means;

means for slideably connecting said cap to said actuation means for preventing said stem means from bending during actuation of said actuation means, said connecting means comprises means for forming a groove disposed in one of said actuation means and cap and a complementary projection means on the other of said actuation means and said cap for being disposed in said groove, said groove means and projection means being of such a relative size and shape to permit relative sliding movement thereof, a second groove means in one of the actuation means and cap and being disposed on the opposite side from the first said groove means, and a second projection means on the other of said actuation means and cap and being disposed in said second groove means for relative sliding movement of one with respect to the other of said second groove means and second projection means, and the first said groove means and the second groove means are disposed on opposite sides of said actuation means and the first said projection means and the second projection means are disposed on opposite interior sides of said cap, said access means being disposed to one side of said groove means and projection means, said access means further being disposed on the opposite side of said cap from said cap outlet opening and said connecting means being disposed generally between said cap outlet opening and said access means, said access means includes means on said cap for forming an access opening, flap means disposed in said opening, and being attached to said cap on at least two sides thereof for preventing accidental actuation of said actuation means and for permitting at least one of said attachments to said cap to be selectively forceably broken for permitting said flap to be pushed against said actuation means for spraying said fluid under pressure from said container, said flap means attachments include a relatively stronger hinge attachment at the bottom thereof and a relatively weaker frangible attachment at the top thereof, whereby the top of said flap means will pivot inwardly of said cap and downwardly onto said actuation means when said flap means is pushed for spraying of said fluid, and wherein said cap is closed at the top thereof to prevent accidental actuation of said actuation means; and means for automatically aligning the nozzle with the cap outlet opening, said aligning means comprising the first said complementary groove means being too small to receive the second projection means whereby the cap cannot be placed over the actuation means in a reverse fashion.

* * * * *